US005474646A

United States Patent [19]

Matteucci

[11] Patent Number: 5,474,646

[45] Date of Patent: Dec. 12, 1995

[54] DEVICE FOR GLUING THE TAIL EDGE OF LOGS OF SHEET MATERIAL

[75] Inventor: Renato Matteucci, San Gemignani di Moriano, Italy

[73] Assignee: Alberto Consani S.p.A., Italy

[21] Appl. No.: 231,935

[22] Filed: Apr. 25, 1994

[30] Foreign Application Priority Data

Apr. 27, 1993 [IT] Italy ..... MI93A0828

[51] Int. Cl.[6] ..... B32B 31/00

[52] U.S. Cl. ..... 156/443; 156/187; 156/446; 242/542.2

[58] Field of Search ..... 156/184, 187, 156/188, 191, 443, 457, 446; 242/542, 542.2, 581

[56] References Cited

U.S. PATENT DOCUMENTS

| | | | |
|---|---|---|---|
| 3,393,105 | 7/1968 | Tellier, Jr. | 156/187 |
| 4,487,377 | 12/1984 | Perini | 242/56.8 |
| 5,242,525 | 9/1993 | Biagiotti | 156/184 X |

FOREIGN PATENT DOCUMENTS

| | | |
|---|---|---|
| 0336911 | 10/1978 | European Pat. Off. . |
| 0481929 | 4/1992 | European Pat. Off. . |

*Primary Examiner*—James Engel

*Attorney, Agent, or Firm*—Evenson, McKeown, Edwards & Lenahan

[57] ABSTRACT

A device for gluing the tail edge of sticks or logs (10) of sheet material, such as paper or the like, comprising a positioning assembly (2) and a gluing assembly (3). The positioning assembly (2) comprises two rollers (4, 5) with a fixed center distance, that can be operated in synchronism to position the log (10) correctly before its transfer to the gluing assembly (3), also comprising a pair of rollers (11, 12) with a fixed center distance that can be rotated in synchronism. The roller (11) is a suction roller, which holds the edge (29) of the log, while the roller (12) can be moved vertically to tip the log (10) onto a glue distributing nozzle (19), which applies a layer of adhesive to the log itself, before it is discharged by rolling between a plane (20) and a belt (22) opposite, which presses on the log (10) causing the tall edge (29) to adhere to the glue-coated section of the log.

10 Claims, 5 Drawing Sheets

DEVICE FOR GLUING THE TAIL EDGE OF LOGS OF SHEET MATERIAL

DESCRIPTION

The present invention relates to a device for gluing the tail edge of sticks or logs of sheet material, particularly paper.

Industries manufacturing toilet paper, kitchen paper and the like, make use of so-called re-winding machines which, starting from large-sized rolls, produce sticks or logs that are subsequently cut transversely to the required length.

As the log leaves the re-winding machine, the end of the paper must be glued down. This is achieved with special gluing devices.

The gluing devices known to the art are excessively complicated and costly, and do not always ensure perfect positioning of the log during application of the glue, thus affecting the quality of the result of the gluing operation.

The aim of the invention is to provide a gluing device that guarantees perfect application of the glue and hence optimal gluing quality.

Another aim of the invention is to provide a gluing device that can work at high speeds, and is thus capable of gluing logs that are delivered in rapid succession.

Yet another aim of the invention is to provide a gluing device that is of simple connection and is therefore economical.

These aims are achieved by the device for gluing the end of sticks of sheet material or logs, as described in the attached claims.

Further characteristics of the invention will be made clearer by the detailed description that follows, which refers to a purely exemplary, and therefore non-restrictive, embodiment illustrated in the appended drawings, in which.

Figure 1:
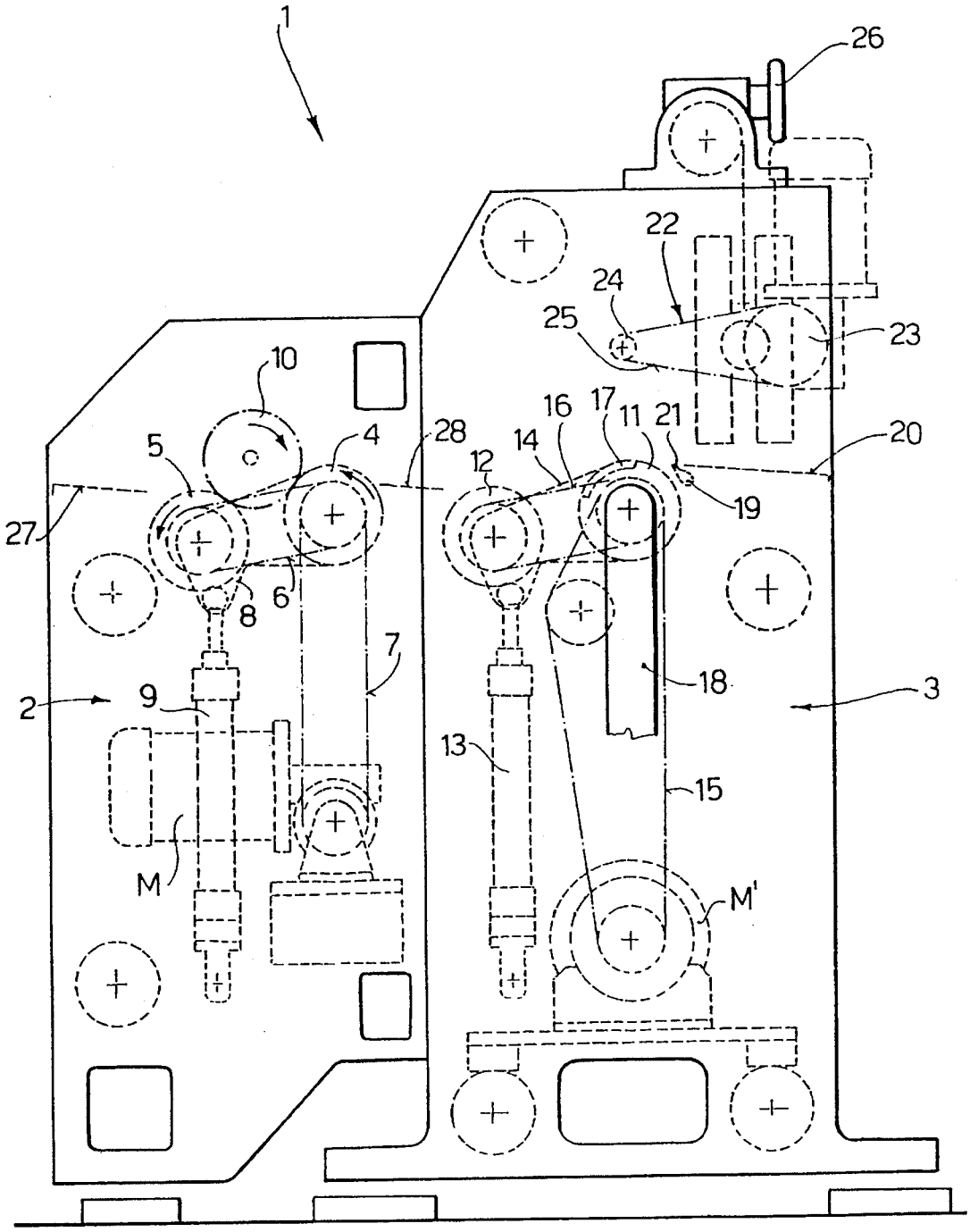
FIG. 1 is a schematic side view of the gluing device according to the invention.

With reference to these figures, 1 indicates, as a whole, the device for gluing the tail edge of sticks or logs of sheet material, particularly paper.

This gluing device can be situated right at the discharge point of a re-winding machine, in order to glue the tail edge of the logs as they leave the machine, or it can constitute a separate machine, that is fed by an accumulator where the logs are temporarily stored.

The gluing device 1 comprises a log positioning assembly 2, situated upstream, and a gluing assembly proper 3.

The positioning assembly 2 comprises a pair of rollers 4, 5 that can be operated in synchronism by means of a belt 6. During operation, the roller 4 has a fixed axis and is operated by the motor M by means of belt transmission 7.

The roller 5 is supported between side plates 8 having their fulcrum on the axis of the roller 4, so that it can be lifted by means of a piston 9, maintaining a constant distance from the roller 4, which is obviously smaller than the diameter of the stick or log 10, shown in position between the pair of rollers 4, 5 in FIG. 1.

The gluing assembly 3 also comprises a pair of rollers 11, 12, the former with a fixed axis and the latter with a mobile axis that can be moved by means of a piston 13 that acts on lateral supporting plates 14 of the roller 12, having their fulcrum on the axis of the roller 11. The roller 11 takes its motion from a motor M' through a belt 15 and transmits it in synchronism to the roller 12 by means of a belt 16.

The mantle or upper surface of the roller 11 has at least one perforated section 17, shown schematically in the appended figures 1, for suction of the edge of the log, as a result of the vacuum created in the roller by means of a suction duct 18 and a vacuum pump not shown.

Immediately downstream of the roller 11, in the space between the roller mantle and the leading edge of an inclined plane or slide 20, through which the log is discharged, a glue applicator nozzle 19, having a continuous or broken end slit 21 for discharge of the glue, extends transversely substantially across the whole length of the log 10.

Above the log discharge plane 20 is situated a continuous belt (or a plurality of belts) 22, which winds around two end rollers 23 and 24, one of which is motorised, the lower branch 25 of which is substantially parallel to the discharge plane 20. The two rollers 23, 24 supporting the continuous belt 22 are mounted so as to slide vertically, so that the position of the belt 22 can be adjusted, for example by means of a hand-wheel 26, to adapt it to the diameter of the logs 10 which must be advanced between the lower branch 25 of the belt 22 and the discharge plane 20, as will be better described below.

The gluing device according to the invention works as follows.

Figure 2:
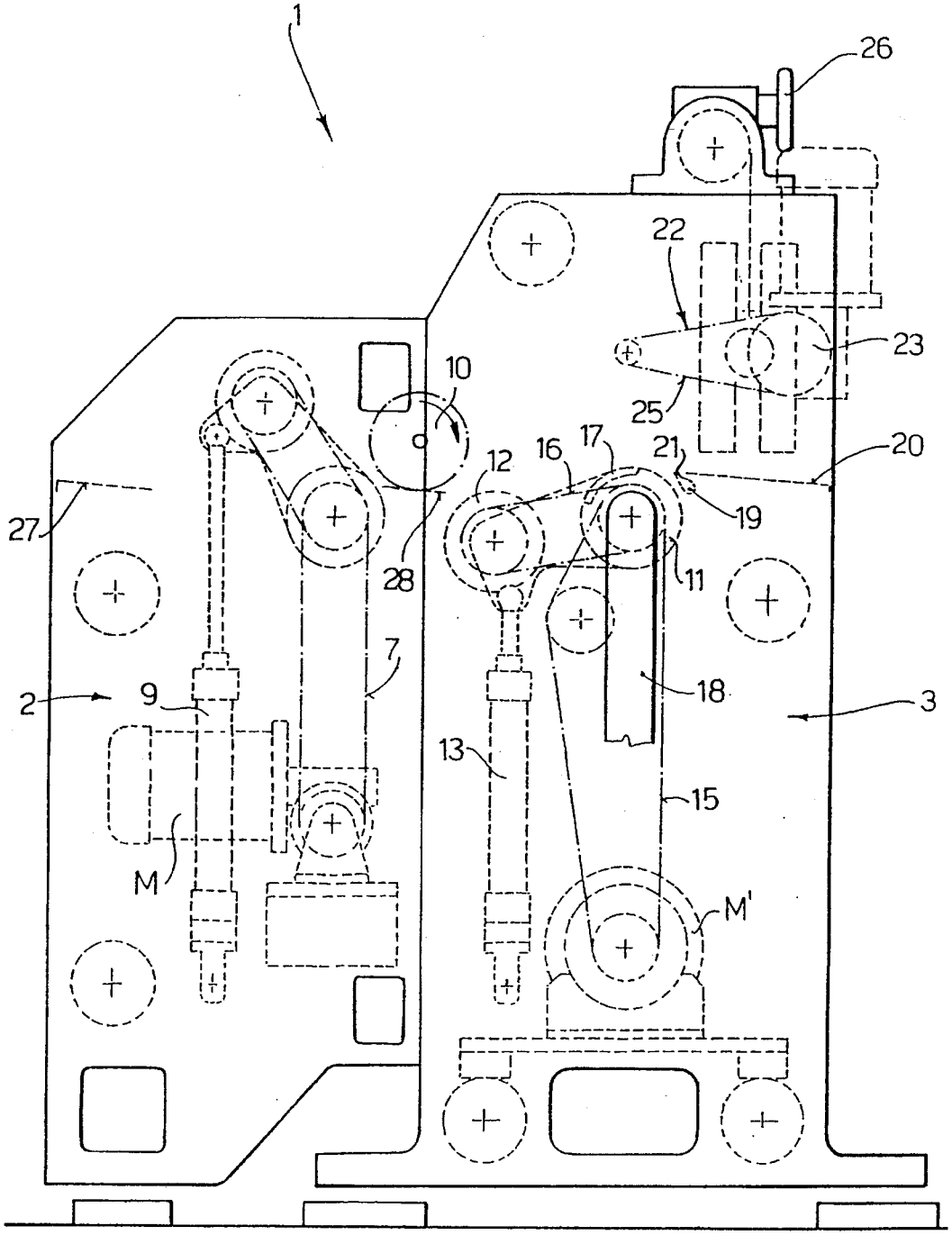
FIGS. 2, 3 and 4 are similar views to that in FIG. 1, illustrating successive stages of the log-gluing operation.

The log 10, coming from the re-winding machine, or from an accumulator upstream, rolling on a chute 27 in the direction indicated by fie arrow, falls from the space between the rollers 4, 5 of the positioning assembly 2, which are made to rotate, in the direction indicated by the respective arrows, for a predetermined time, in order to position the edge of the sheet material correctly. The rotation of the rollers 4 and 5 is then stopped and the piston 9 is operated in order to cause the roller 5 to be raised and thus the log 10 to be transferred, through a further chute 28, into the space between the rollers 11, 12 of the gluing assembly 3 (see FIGS. 2 and 3).

Figure 3:
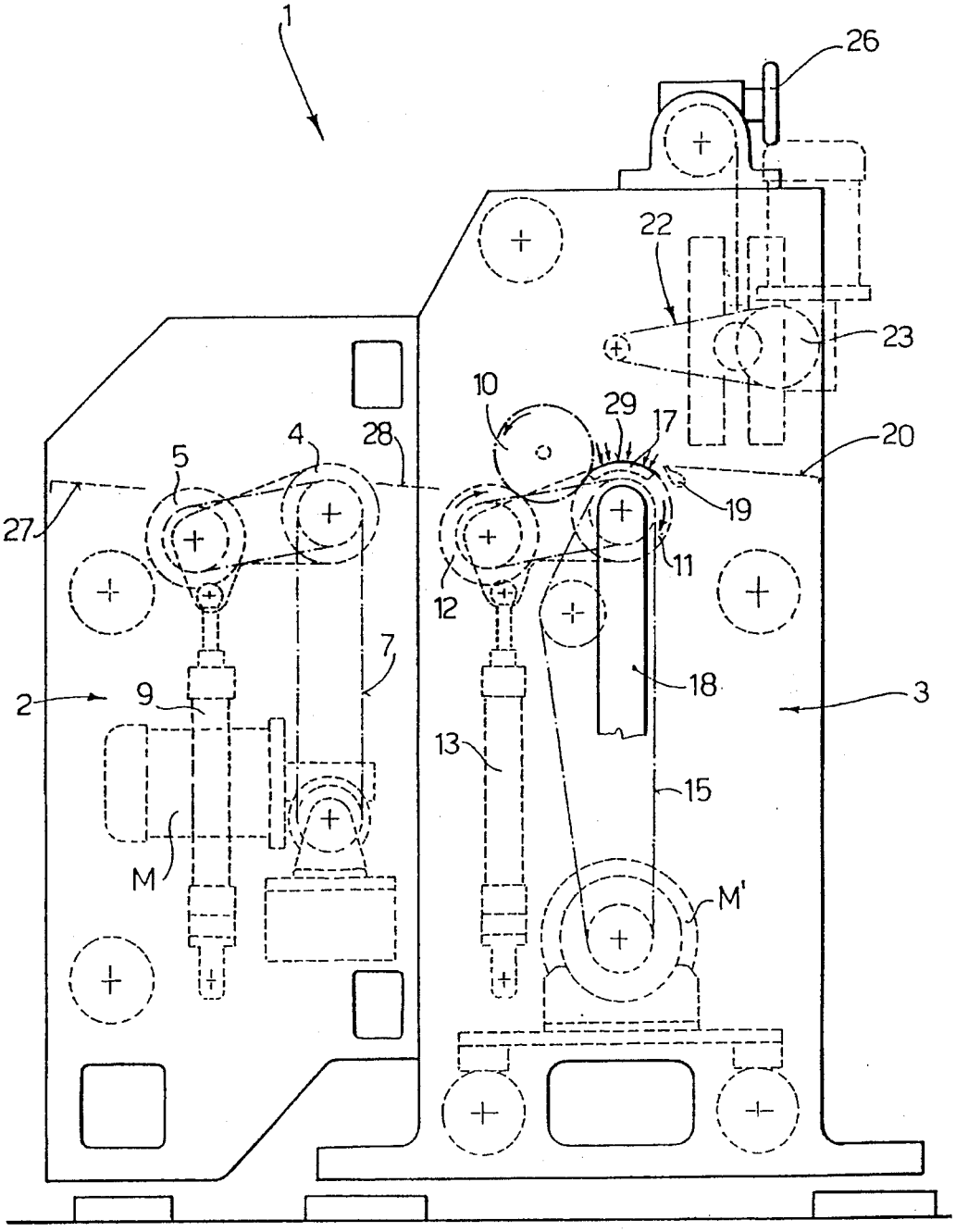
Figure 4:
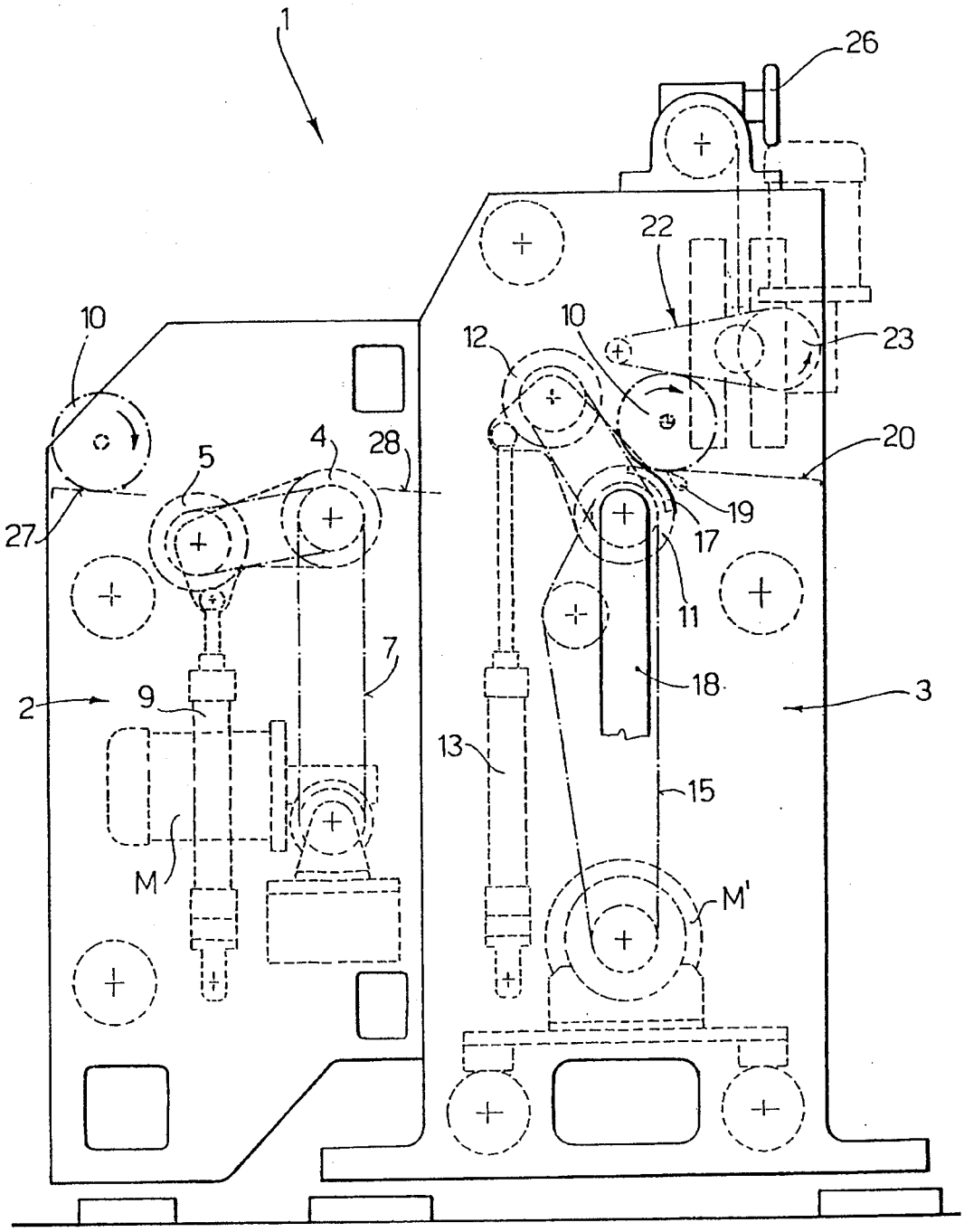
Figure 6:
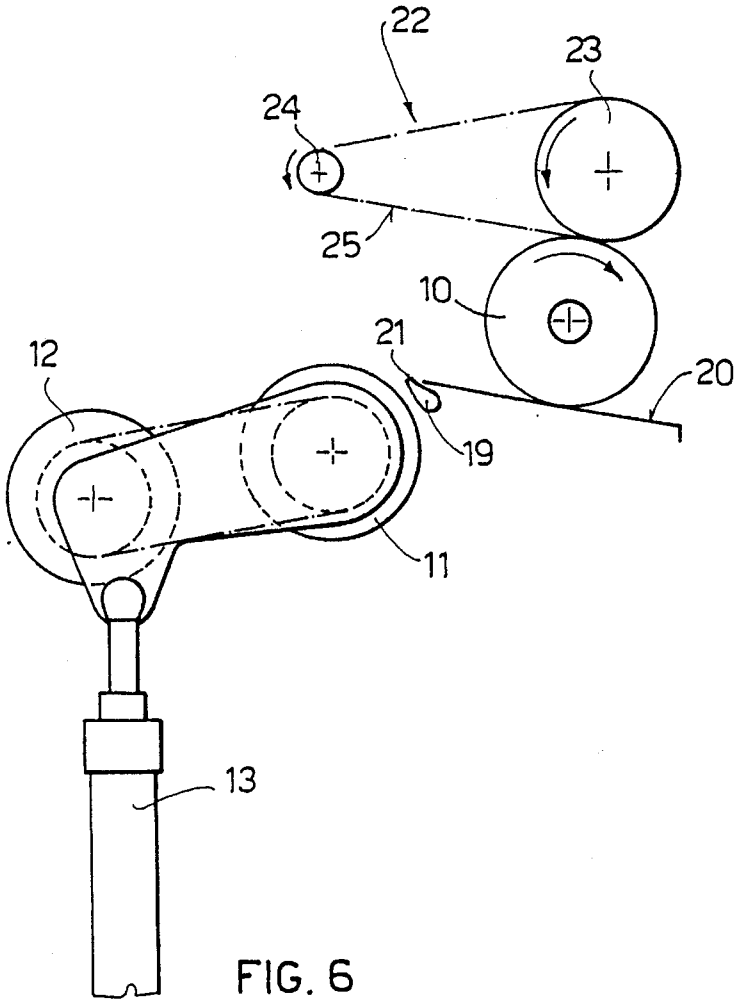
FIGS. 5 and 6 are schematic partial views with respect to those of the preceding figures, illustrating other two successive steps in the gluing operation.
Figure 5:
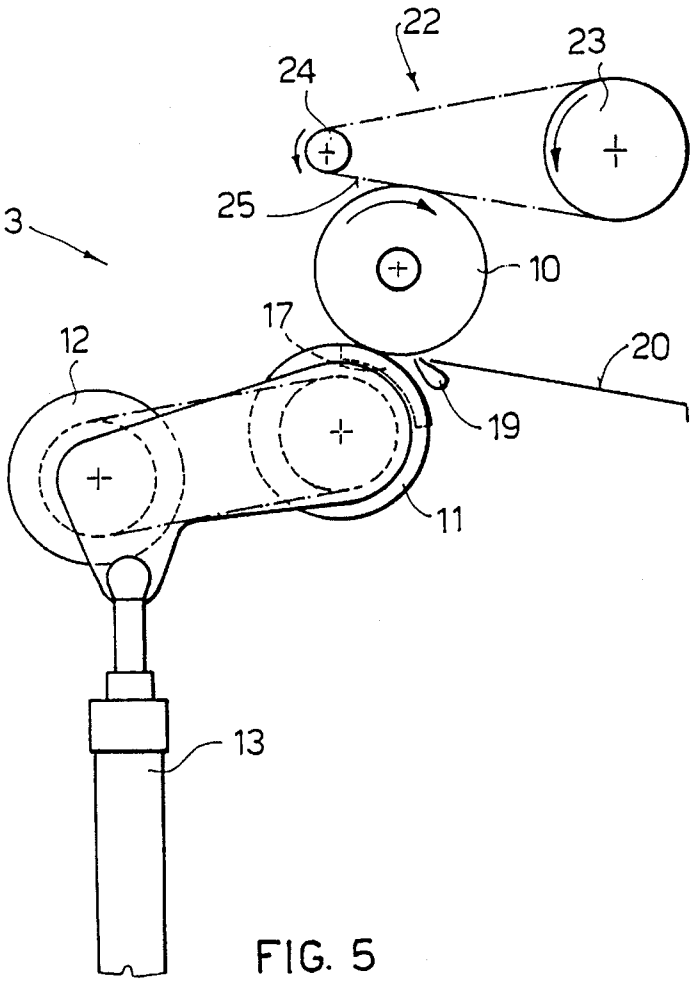

The log 10 thus reaches the gluing assembly with the tail edge always in the same position, so that rotation of the rollers 11, 12 in a clockwise direction (see arrows in FIG. 3) causes partial unwinding of the log 10, whose edge 29 adheres to the suction section 17 of roller 11, in which a vacuum is created (FIG. 3). In this position, the rollers 11, 12 are stopped and the roller 12 is raised by operating the piston 13 (FIG. 4), in order to tip log onto the discharge plane 20. When the log 10 is in contact between the roller 11 and the leading edge of the plane 20, adhesive is applied along a length of the log 10 by means of the applicator nozzle 19. The log 10 is then "grasped" by the continuous upper belt 22, which presses it gently against the plane 20, making it roll towards the discharge and thus causing the tail edge 29 to adhere along the glue-coated portion of the log. Meanwhile, the roller 12 of the gluing assembly 2 has been lowered to the starting position (FIG. 5 and 6) and is ready to receive another log from the upstream positioning assembly 2.

From what has been described the advantages of the gluing device according to the invention will be clear, said device being able to operate at high speeds, in that while the gluing assembly proper 3 applies the glue 10, a new log is prepared for gluing on the positioning assembly upstream 2.

It is also clear that the gluing assembly according to the invention ensures accurate application of the glue on the log, and thus a constant quality of the gluing of the rail edge 29.

I claim:

1. A gluing device for the tail edge of sticks or logs of sheet material, particularly paper, to be situated at the discharge point of a re-winding machine, or downstream of a log accumulator-feeder, wherein a gluing assembly comprising a pair of rollers configured to be operated in synchronism, one of the rollers being a suction roller with a fixed axis and operative to hold the tail edge of a log in a predetermined position via a perforated section (17) at an outer surface thereof, and the other roller being arranged to move in a substantially vertical direction to tip the log onto a glue applicator nozzle which spreads a thin layer of glue substantially along a length of the log, and means for discharging the log with a rolling action so as to make the tail edge adhere to the blue-coated length of the log.

2. A device according to claim 1, wherein said means consists of a rolling plane and a continuous belt, which presses on the log with one of its branches substantially parallel to the plane.

3. A device according to claim 2, wherein said belt is positionable at an adjustable distance from the plane.

4. A device according to claim 2, wherein said glue distributing nozzle is situated in a space between the outer surface of said suction roller and the leading edge of said plane.

5. A device according to claim 1, wherein said suction roller moves along a circular path with a center thereof on the axis of the suction roller.

6. A device according to claim 1, wherein said rollers are arranged to be intermittently rotatable in an unwinding direction of the log.

7. A device according to claim 1, wherein a positioning assembly is arranged upstream of the gluing assembly so as to position an incoming log correctly for subsequent transfer to the gluing assembly.

8. A device according to claim 7, wherein said positioning assembly comprises a second pair of rollers operable in synchronism, of which the roller of the second pair furthest from the gluing assembly is substantially vertically movable to cause the log to roll towards the gluing assembly.

9. A device according to claim 8, wherein the substantially vertically movable roller of the second pair moves along a circular path such that a center thereof is on the axis of the other roller of the second pair.

10. A re-winding machine for sheet materials, particularly paper, comprising a device for gluing the tail edge of a log having a pair of rollers configured to be operated in synchronism, one of the rollers being a suction roller with a fixed axis and operative to hold the tail edge of a log in a predetermined position via a perforated section at an outer surface thereof, and the other roller being arranged to move in a substantially vertical direction to tip the log onto a glue applicator nozzle which spreads a thin layer of glue substantially along a length of the log, and means for discharging the log with a rolling action so as to make the tail edge adhere to the blue-coated length of the log.

* * * * *